United States Patent [19]

Mohaupt

[11] Patent Number: 4,736,182

[45] Date of Patent: Apr. 5, 1988

[54] MECHANICAL DISPLACEMENT AMPLIFIER AND THERMOSTAT EMBODYING SAME

[75] Inventor: Udo H. Mohaupt, Cambridge, Canada

[73] Assignee: Canadian Industrial Innovation Centre, Waterloo, Canada

[21] Appl. No.: 7,540

[22] Filed: Jan. 28, 1987

[51] Int. Cl.[4] ..... H01H 37/46; H01H 37/74

[52] U.S. Cl. ..... 337/386; 337/318

[58] Field of Search ..... 337/313, 314, 317, 319, 337/345, 353, 368, 375, 386, 391, 135, 392

[56] References Cited

U.S. PATENT DOCUMENTS

| | | | |
|---|---|---|---|
| 2,483,670 | 10/1949 | Reingruber | 337/386 |
| 3,030,475 | 4/1962 | Glaberson | 337/318 |
| 3,158,718 | 11/1964 | McCarrick | 337/386 |

*Primary Examiner*—H. Broome

*Attorney, Agent, or Firm*—R. Craig Armstrong

[57] ABSTRACT

A mechanical displacement amplifier is disclosed in which a displacement amplifying spring member essentially in the shape of a shallow V is positioned between a reference point structure and a displacement member so as to buckle in response to movement of the displacement member towards the reference point structure. A dimple is provided adjacent the buckling point of the spring member to prevent it from straightening entirely. A thermostat embodying the mechanical displacement amplifier is also disclosed, in which a push rod between a microswitch and the buckling point of the spring member actuates the microswitch. A temperature adjustment dial positions the reference point structure, and a temperature sensing unit is the displacement member.

10 Claims, 3 Drawing Sheets

MECHANICAL DISPLACEMENT AMPLIFIER AND THERMOSTAT EMBODYING SAME

BACKGROUND OF THE INVENTION

This invention relates to a mechanical displacement amplifier and to a thermostat embodying the mechanical displacement amplifier.

There are of course many situations in which it is desireable or necessary to take a relatively small displacement and amplify that displacement into a larger one. Mechanisms for doing so can range from the very simple to the very complex, from a simple lever, for example, to a complex arrangement of linkages, levers, cams, inclined planes, screws and other basic mechanical elements.

The present invention is directed towards an extremely simple, reliable and sensitive mechanism for achieving the desired displacement amplification at low cost. The invention has particular applications in thermostats, limit switches and the like, but is not limited to such applications. This description of the invention will focus on the thermostat application by way of example only.

In any thermostat, it is desirable to have a mechanism which is inexpensive, reliable, easily calibrated, and sensitive. There are of course many thermostat mechanisms in the prior art, many using mechanical displacement amplifiers of one sort or another to amplify the relatively small displacement of the temperature sensing unit into a displacement large enough to trigger a switch. Most conventional displacement amplifiers used for such applications employ various combinations of linkages, levers, and cams to achieve the desired results.

SUMMARY OF THE INVENTION

It is an object of the invention to provide a novel and effective mechanical displacement amplifier.

It is a further object of the invention to provide a novel and effective thermostat embodying the mechanical displacement amplifier.

In the invention, displacement amplification is produced by a single stamped and formed spring component. The simplicity of the mechanism makes it particularly attractive from a manufacturing point of view.

In a thermostat, the mechanism of the present invention provides excellent sensitivity by providing a significant displacement amplification. For example, a displacement differential of approximately 0.0006 to 0.0018 inches (representing a temperature differential of roughly 1 to 3 degrees Fahrenheit in a typical temperature sensing diaphragm element) can be amplified sufficiently to toggle a relatively insensitive microswitch, such as the snap action microswitches typically used in thermostats.

In essence, the invention comprises a reference point structure, a displacement member which moves towards and away from the reference point structure, and a displacement amplifying spring member essentially in the shape of a shallow V. The bias of the spring member is towards straightening the spring member. The base of the V-shape constitutes a buckling point. The ends of the V-shape are positioned to be constrained between the reference structure and the displacement member. Movement of the displacement member with respect to the reference structure produces amplified displacement at the buckling point.

Embodied in a thermostat comprising a temperature sensing unit, a temperature adjustment, a snap action microswitch, and means for actuating the microswitch in relation to the relative positions of the temperature sensing unit and the temperature adjustment, the invention provides means for actuating the microswitch. This means comprises a displacement amplifying member essentially in the shape of a shallow V. The base of the V-shape is connected to actuate the microswitch, the ends of the V-shape being constrained between the temperature adjustment and the temperature sensing unit.

Further features of the invention will be described or will become apparent in the course of the following detailed description.

BRIEF DESCRIPTION OF THE DRAWINGS

In order that the invention may be more clearly understood, the preferred bodiment thereof, embodied in a thermostat by way of example, will now be described in detail with reference to the accompanying drawings, in which.

DETAILED DESCRIPTION OF THE PREFERRED EMBODIMENT

Figure 1:
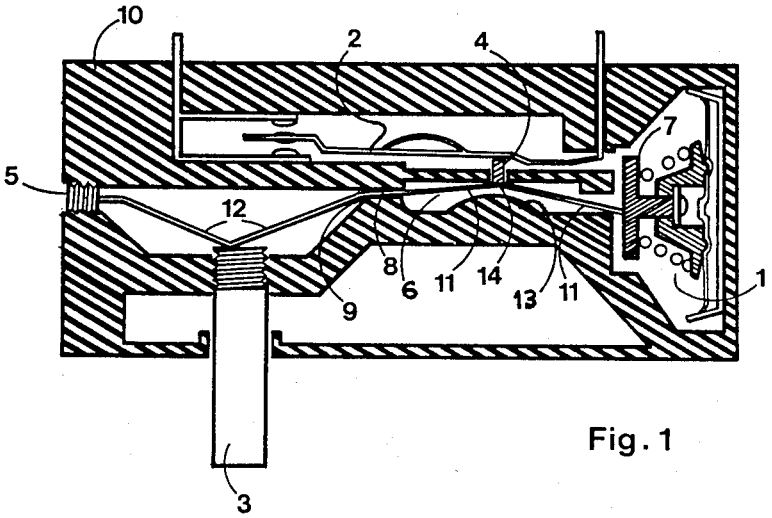
FIG. 1 is a cross-sectional view of the preferred embodiment in a thermostat.

The preferred embodiment of the mechanical displacement amplifier and of the thermostat in which it is installed are shown in FIG. 1. The thermostat comprises a conventional temperature sensing unit 1, a typical snap action microswitch 2, a temperature adjustment shaft 3, a switch push rod 4, a calibrating screw 5, and the displacement amplifying member, spring member 6. The temperature adjustment shaft 3 will usually carry a dial (not shown) which turns with respect to a temperature scale, to which the thermostat is calibrated as described later below. The principle of operation and the various features of the device are illustrated in FIGS. 2 to 5.

The spring member 6 is essentially in the shape of two shallow V's connected to each other by a small straight portion 8. This spring member is conveniently stamped and formed in one piece, from spring steel, heat treated so that it is biased towards a straightened or unbuckled position. One of the shallow V's constitutes a temperature setting portion 12 of the spring member 6, and the base of the V ordinarily contacts the temperature adjustment shaft 3. The other V constitutes the displacement amplifying portion 11, and is positioned so that its buckling point 14, the base of the V, contacts the microswitch push rod 4. The ends of the spring member 6 are free-floating, but in operation are usually constrained between the calibration screw 5 and the central post 7 of the temperature sensing unit 1, the central post 7 being the portion of the temperature sensing unit 1 which displaces in response to temperature change. The straight portion 8 of the spring member 6 is positioned in a narrow passageway 9 in the thermostat housing 10, so that it is only free to move lengthwise. The purpose of the straight portion 8 is to permit the spring member 6 to be displaced longitudinally through the narrow passageway 9 in response to rotation of either the calibration screw 5 or the temperature adjustment shaft 3.

Figure 6:
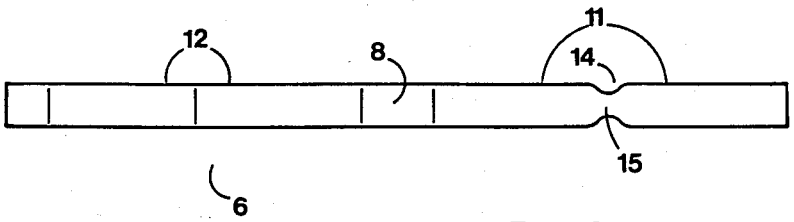
FIG. 6 is a top view of the spring member.

Preferably, but not essentially, the spring member 6 has a reduced section 15 at buckling point 14, as shown in FIG. 6. This is so that the spring member 14 tends to act more as a hinge than as a buckling column, i.e. so that the sides of the V-shape are relatively straight and there is a distinct break at the buckling point 14, rather than there being a general bowing of the spring member 6.

There is of course a design compromise in this area. A true hinge would perform ideally, but would be more expensive than in the invention. The reduced section 15 causes the spring member 6 to behave more as if there was a hinge at its buckling point 14. However, if the section is reduced too much, this could weaken the area excessively, possibly leading to premature failure. It must be recognized that the spring member 6 should be able to withstand periodic cycling over a good period of time.

In the spring member 6's favour is that generally the number of cycles is not truly all that great, and the displacement in each cycle is not large. Furthermore, because the spring member 6 is generally in compression when cycling, the tensile force component (i.e. at the outer edge of the buckling point 14) is not very large.

The position of the straight portion 8 relative to the passageway 9, and hence the position of the central end of the displacement amplifying portion 11 of the spring 6, is determined solely by the position of the calibration screw 5 (which ordinarily will remain fixed after initial calibration) and the temperature adjustment shaft 3.

Considering the central end of the displacement amplifying portion 11 to be fixed, it can then be seen that the position of the microswitch push rod 4 is determined by the position of the central post 7 of the temperature sensing unit 1 with respect to the spring member 6. Extension of the central post 7 causes the displacement amplifying portion 11 of the spring 6 to buckle, resulting in lateral movement of the buckling point 14 against the microswitch push rod 4.

The displacement amplification arises as a result of taking advantage of the characteristic of a buckling column that at the buckling point, a small compression produces a large lateral buckling displacement. In the ideal case of a hinge positioned at the buckling point 14, this effect is of course even more pronounced.

The housing 10 is provided with a buckling dimple 13 under the buckling point 14, which prevents the displacement amplifying portion 11 of the spring member 6 from straightening under any circumstances, so that it is always slightly buckled.

Figure 2:
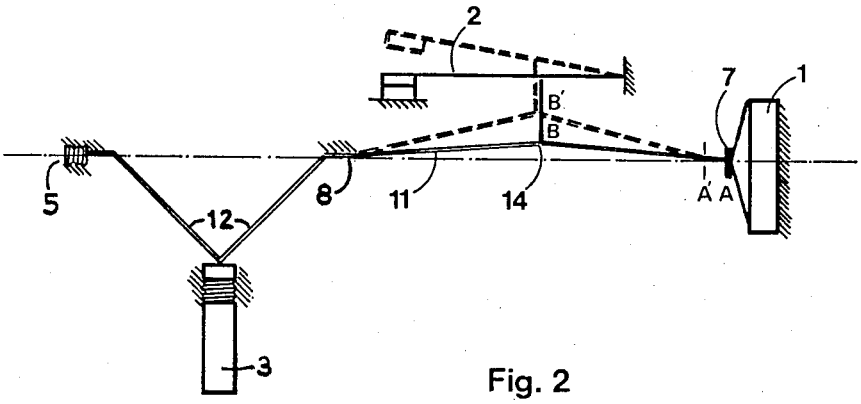
FIG. 2 is a sketch illustrating the operation of the thermostat in its normal controlling state.

FIG. 2 shows the thermostat in its normal controlling state. As the temperature sensing unit 1 is subjected to a slight temperature increase, its central post 7 extends, causing the end of the spring member 6 to be displaced from position A to position A'. Since the buckling point 14 of the displacement amplifying portion 11 is not restrained, it is displaced laterally from position B to position B40 to compensate for the displacement at A. This causes the push rod 4 to toggle the microswitch 2 and shut off the heating system.

As the temperature decreases, the temperature sensing unit 1 retracts, the spring member 6 returns to its original configuration, and the microswitch toggles back to reactivate the heating system. The thermostat continues to cycle in this manner at a rate dictated by the particular thermal conditions that apply.

Figure 3:
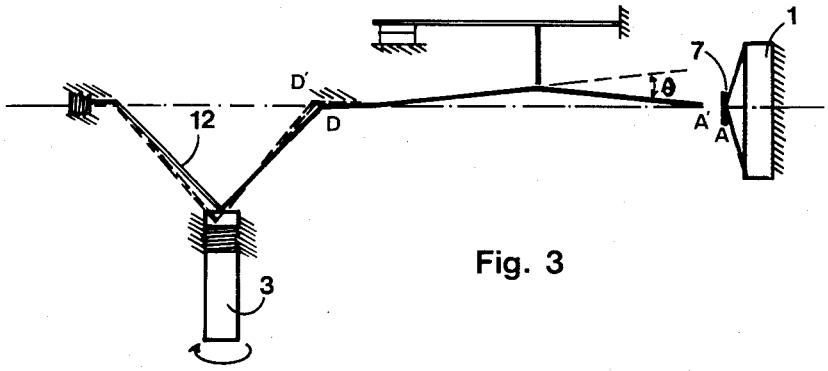
FIG. 3 is a sketch illustrating the effect of increasing the thermostat's control temperature setting through rotation of the temperature adjustment shaft.

As shown in FIG. 3, the temperature control setting may be increased by screwing the threaded temperature adjustment shaft 3 out a certain amount. This allows the temperature setting portion 12 of the spring member 6 to spring back from position D to position D', thereby in effect drawing its free end away from position A and the central post 7 of the sensing unit 1, to position A'. The microswitch contacts now remain closed until the temperature increases to a level where the temperature sensing unit 1 extends further to make up the gap between position A and position A'. When this occurs the new temperature level has been reached and the thermostat controls this level as described above and as illustrated in FIG. 2.

Figure 4:
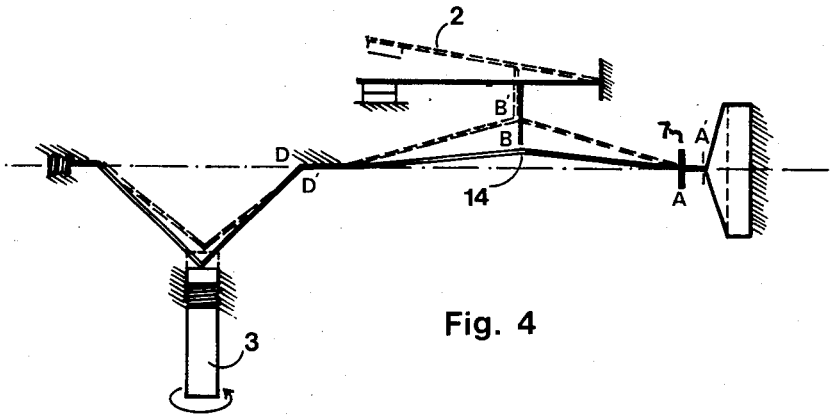
FIG. 4 is a sketch illustrating the effect of decreasing the thermostat's control temperature setting.

The control setting may be decreased by screwing the temperature adjustment shaft 3 in a certain amount. As shown in FIG. 4, this displaces point D of the spring member 6 to position D'. Since end A of the displacement amplifying portion 11 of the spring member 6 is restrained by the central post 7 of the temperature sensing unit 1, the buckling point 14 is forced to deflect laterally from position B to position B' to compensate for the displacement at D. This holds the contacts of the microswitch 2 open until the temperature decreases to a level where the central post 7 retracts sufficiently to allow point A to move to position A' and the buckling point 14 to move back from position B' to position B. The instant the latter occurs and the microswitch contacts close again, the proper temperature level has been reached and the thermostat continues to control this new level.

Figure 5:
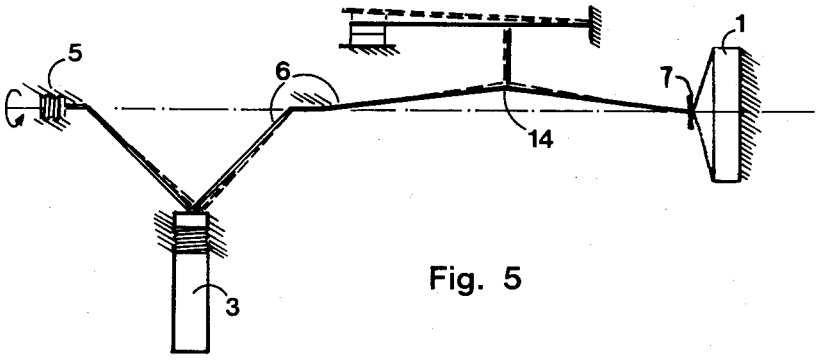
FIG. 5 is a sketch illustrating the operation of the thermostat's calibration screw.

The operation of the calibration screw 5 is shown in FIG. 5. This screw allows the thermostat to be calibrated to any temperature. For calibration, the temperature sensing unit 1 is exposed to the desired calibration temperature and the temperature adjusting shaft 3 is turned to the corresponding control setting. The calibration screw 5 is then screwed in so as to push on end E of the spring member 6, until this forces the buckling point 14 to deflect laterally from position B to position B', thereby causing the microswitch contacts to open. The instant this occurs the thermostat is properly calibrated.

It is an advantage of the invention that displacement amplifiers and thermostats of different sensitivities can be designed, simply by varying the angle A of the spring member 6, being the angle of the V-shape away from 180 degrees at which the microswitch is toggled. In the preferred embodiment, the angle is 8 degrees or less. A larger angle will still operate according to the same principle, and thus can still be considered to be within the scope of the invention, but having a larger angle reduces the sensitivity of the mechanism, which will not be desireable for most applications. On the other hand, too small an angle increases the force required to produce the buckling or bending, risking jamming. Too small an angle might also produce an amplifier or thermostat with greater sensitivity than required or desired for most tasks.

It will be appreciated that many variations on the invention will be obvious to those knowledgeable in the field, and such obvious variations are within the scope of the invention as described and claimed, whether or not expressly described.

For example, in the preferred embodiment the V's of the displacement amplifying portion 11 and temperature setting portion 12 are shown facing in opposite directions to each other. This is by no means essential, and was chosen simply to produce an efficient layout within the housing 10. The mechanism of the thermostat would work just as well if the two V's were oriented in the same direction.

Furthermore, it is not essential to the invention that the temperature adjustment and calibration be effected by a V-shape, although that is a convenient and desireable way of doing it. The temperature adjustment shaft 3 could act directly on the central end of the displacement amplifying portion 11, with no calibration, with calibration built into the dial position on the shaft 3, or with some other suitable form of calibration. Or, some other means could be used to position the central end of the displacement amplifying portion 11 in response to the desired temperature. It should be noted that in the illustrated preferred embodiment, the angle of the V-shape in the temperature setting portion 12 is relatively large, so that the displacement amplification principle used in the displacement amplifying portion 11 is not in use in temperature setting portion 12.

Figure 7:
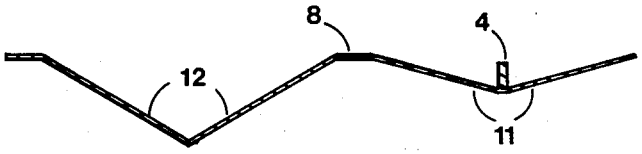
FIG. 7 is a sketch illustrating a "close on rise" version of the thermostat.

Another variation is illustrated in FIG. 7. In the preferred embodiment described above, the thermostat is of the "open on rise" type; that is, the microswitch contacts open to shut off the furnace when the temperature rises. In FIG. 7, a "close on rise" embodiment is shown, such an embodiment being desireable for cooling rather than heating application. This embodiment is identical in general structure and principle, except that the displacement amplifying portion 11 is buckled in the opposite direction (or, looked at another way, the switch push rod 4 is on the opposite side—the inside—of the displacement amplifying portion 11's V-shape). The result is that an increase in temperature causes the switch push rod 4 to move away from the microswitch 2, as the displacement amplifying portion 11 buckles. This of course results in the microswitch contacts closing.

Figure 8:
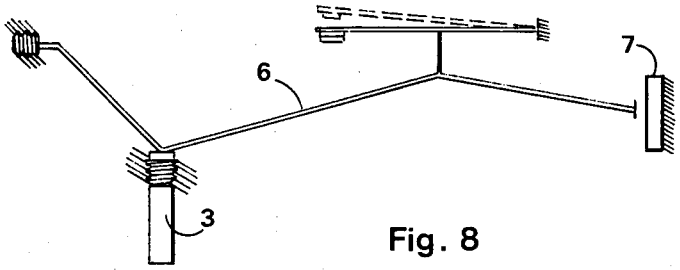
FIG. 8 is a sketch illustrating an alternative embodiment.

Yet another variation is shown in FIG. 8. In this embodiment, the spring member 6 comprises a V-shape disposed between the temperature adjustment screw and the central post 7 of the temperature sensing unit 1. The essential difference is that the straight portion 8 is missing, so that the ends of the V-shape are not so constrained against movement. The result is a mechanism which is even simpler than in the preferred embodiment, but which will not behave in as linear a manner, making it unsatisfactory for some applications. In the preferred embodiment, because the narrow passageway controls the position of the ends of the V-shape, the performance of the amplifier can be treated as linear for most applications, or at least any non-linearity can be easily compensated for in the temperature scale scribed onto the housing for use with the temperature adjustment shaft.

What is claimed as the invention is:

1. A mechanical displacement amplifier comprising:

a reference point structure;

a displacement member which moves towards and away from said reference point structure;

a displacement amplifying spring member including a displacement amplifying portion essentially in the shape of a shallow V, the bias of said spring member being towards straightening said displacement amplifying portion, the base of the V-shape constituting a buckling point;

the ends of said displacement amplifying spring member being positioned to be constrained between said reference point structure and said displacement member with one end of said displacement amplifying portion adjacent said displacement member, and the other end of said displacement amplifying portion fixed with respect to said reference point structure, whereby movement of said displacement member with respect to said reference structure produces amplified displacement at said buckling point.

2. A mechanical displacement amplifier as recited in claim 1, further comprising means positioned to maintain said spring member in a slightly buckled state by preventing said spring member from straightening entirely.

3. A mechanical displacement amplifier as recited in claim 1, in which said shallow V-shape is configured to have an angle of sustantially eight degrees or less away from a fully straightened position during its intended operating range.

4. A mechanical displacement amplifier as recited in claim 1, in which said spring member is reduced in section in the region of its buckling point.

5. In a thermostat comprising a temperature sensing unit, a temperature adjustment, a snap action microswitch, and means for actuating said snap action microswitch in relation to the relative positions of said temperature sensing unit and said temperature adjustment, the improvement in which said means for actuating said microswitch comprises a displacement amplifying member essentially in the shape of a shallow V, the base of said V being connected to actuate said microswitch, the ends of said V being constrained between said temperature adjustment and said temperature sensing unit.

6. A thermostat improvement as recited in claim 5, further comprising means positioned to maintain said spring member in a slightly buckled state by preventing said spring member from straightening entirely.

7. A thermostat improvement as recited in claim 5, in which said shallow V-shape is configured to have an angle of sustantially eight degrees or less away from a fully straightened position during its intended operating range.

8. A thermostat improvement as recited in claim 5, in which said spring member is reduced in section in the region of its buckling point.

9. A thermostat improvement as recited in claim 5, in which said temperature adjustment comprises a second V-shaped spring member, one end of said second V-shaped being integrally connected with one end of said first V-shape via an integral straight portion, said temperature adjustment acting on said second V-shape to produce displacement of said straight portion and thus the integral end of said first V-shape.

10. A thermostat improvement as recited in claim 9, further comprising a calibration screw acting on said second V-shape, one of said calibration screw and said temperature adjustment acting on the end of said second V-shape, and the other acting at the base of said second V-shape.

* * * * *